US009555927B2

(12) United States Patent
Nakayama

(10) Patent No.: US 9,555,927 B2
(45) Date of Patent: Jan. 31, 2017

(54) BOTTLE

(75) Inventor: Tadayori Nakayama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/239,557

(22) PCT Filed: Aug. 29, 2012

(86) PCT No.: PCT/JP2012/071802

§ 371 (c)(1),
(2), (4) Date: Feb. 19, 2014

(87) PCT Pub. No.: WO2013/031812

PCT Pub. Date: Mar. 7, 2013

(65) Prior Publication Data

US 2014/0190928 A1 Jul. 10, 2014

(30) Foreign Application Priority Data

Aug. 30, 2011 (JP) ..... 2011-187491

(51) Int. Cl.
*B65D 90/12* (2006.01)
*B65D 23/00* (2006.01)
(Continued)

(52) U.S. Cl.
CPC ..... *B65D 23/001* (2013.01); *B65D 1/0276* (2013.01); *B65D 79/005* (2013.01)

(58) Field of Classification Search
CPC ..... B65D 79/005; B65D 1/0261; B65D 1/40
(Continued)

(56) References Cited

U.S. PATENT DOCUMENTS 7,287,658 B1 * 10/2007 Johnson ..... B65D 79/005 141/4
2002/0074336 A1 6/2002 Silvers
(Continued)

FOREIGN PATENT DOCUMENTS

CN 101084149 A 12/2007
JP A 2008-24314 2/2008
(Continued)

OTHER PUBLICATIONS

Nov. 13, 2012 Search Report issued in International Patent Application No. PCT/JP2012/071802 (with translation).
(Continued)

*Primary Examiner* — Shawn M Braden
(74) *Attorney, Agent, or Firm* — Oliff PLC

(57) ABSTRACT

A tubular bottle is formed of a synthetic resin material having a bottom part. A bottom wall part of the bottom part includes a grounding part located at an outer circumferential edge thereof, a standing peripheral wall part which is connected from a radial inner side of the bottle to the grounding part and which extends upward, a movable wall part that protrudes, from an upper end of the standing peripheral wall part, toward the radial inner side, and a depression peripheral wall part that extends upward from an inner end of the movable wall part in a radial direction of the bottle. The movable wall part is arranged so as to be movable upward centering on a portion connected to the standing peripheral wall part. An upward swelling part is formed at an outer end along the radial direction of the bottle of the movable wall part.

4 Claims, 3 Drawing Sheets

(51) Int. Cl.
*B65D 1/02* (2006.01)
*B65D 79/00* (2006.01)

(58) Field of Classification Search
USPC ..... 220/606, 608, 609, 669; 215/331, 376, 215/373
See application file for complete search history.

(56) References Cited

U.S. PATENT DOCUMENTS

| | | | | |
|---|---|---|---|---|
| 2006/0118508 | A1* | 6/2006 | Kraft et al. | 215/374 |
| 2007/0199915 | A1* | 8/2007 | Denner et al. | 215/375 |
| 2009/0159556 | A1* | 6/2009 | Patcheak et al. | 215/373 |
| 2011/0233166 | A1 | 9/2011 | Hiromichi et al. | |
| 2013/0008913 | A1* | 1/2013 | Boukobza | B65D 1/0223 220/669 |
| 2013/0043209 | A1* | 2/2013 | Wurster et al. | 215/379 |
| 2013/0087954 | A1* | 4/2013 | Tsuchiya | B29C 49/185 264/531 |
| 2013/0180943 | A1* | 7/2013 | Kurihara | B65D 1/0261 215/374 |
| 2014/0131368 | A1* | 5/2014 | Dygert et al. | 220/609 |

FOREIGN PATENT DOCUMENTS

| | | | | |
|---|---|---|---|---|
| JP | A 2008-539141 | | 11/2008 | |
| JP | EP 2662297 | A1 * | 11/2013 | B65D 1/0276 |
| WO | WO 2006/118584 | A1 | 11/2006 | |
| WO | WO 2010/056517 | A1 | 5/2010 | |
| WO | WO 2010/061758 | A1 | 6/2010 | |

OTHER PUBLICATIONS

Nov. 25, 2014 Office Action issued in Chinese Patent Application No. 201280041384.0.

* cited by examiner

BOTTLE

TECHNICAL FIELD

The present invention relates to a bottle.

Priority is claimed on Japanese Patent Application No. 2011-187491, filed on Aug. 30, 2011, the contents of which are incorporated herein by reference.

BACKGROUND ART

Conventionally, as a bottle formed of a synthetic resin material in a shape of a bottomed tube, as set forth in, for instance, Patent Document 1 below, a bottle having a constitution in which a bottom wall part of a bottom part includes a grounding part that is located at an outer circumferential edge, a standing peripheral wall part that is connected from a bottle radial inner side to the grounding part and extends upward, a movable wall part that protrudes from an upper end of the standing peripheral wall part toward the bottle radial inner side, and a depression peripheral wall part that extends upward from a bottle radial inner end of the movable wall part has been known. In the known constitution, the movable wall part rotates about a portion connected to the standing peripheral wall part so as to cause the depression peripheral wall part to move upward, and thereby a pressure reduced in the bottle is absorbed.

CITATION LIST

Patent Literature

[Patent Document 1]
PCT International Publication No. WO2010/061758

SUMMARY OF INVENTION

Means for Solving the Problem

However, the conventional bottle leaves room for improvement in increasing performance of absorbing the pressure reduced in the bottle.

Here, to increase the reduced-pressure absorption performance, it is necessary to secure an amount of upward movement of the movable wall part. To do so, at the portion connected between the movable wall part and the standing peripheral wall part, it can be taken into account that an angle (angle of depression) between a tangential line of the movable wall part and a horizontal plane is increased, for instance, to about 45 degrees with respect to the horizontal plane, and that the movable wall part is formed to be located as low as possible. However, in this case, it is easy to secure the amount of upward movement of the movable wall part, but there is a problem in that it is difficult for the movable wall part to move upward.

Accordingly, the present invention has been made in consideration of these circumstances, and an object of the present invention is to provide a bottle in which improvement in performance of absorbing a pressure reduced in the bottle is attempted to allow a movable wall part to move smoothly.

Means for Solving the Problem

To solve the above-mentioned problem, the present invention proposes the following means.

According to a first aspect of the present invention, a bottle that is tubular, is formed of a synthetic resin material, and has a bottom part. A bottom wall part of the bottom part includes a grounding part that is located at an outer circumferential edge thereof, a standing peripheral wall part which is connected, from a radial inner side of the bottle, to the grounding part and which extends upward, a movable wall part that protrudes from an upper end of the standing peripheral wall part toward the radial inner side of the bottle, and a depression peripheral wall part that extends upward from an inner end of the movable wall part in a radial direction of the bottle. The movable wall part is disposed so as to be movable upward centering on a portion connected to the standing peripheral wall part along with the depression peripheral wall part. An upward swelling part which swells upward is formed at an outer end along the radial direction of the bottle of the movable wall part.

With this configuration, when the movable wall part moves centering on the portion connected between the movable wall part and the standing peripheral wall part, the upward swelling part becomes a starting point when the movable wall part moves for the first time. In this case, the upward swelling part begins to move upward depending on a change in an internal pressure of the bottle. Thereby, in accordance with the movement, the entire movable wall part moves upward. As a result, it is possible to smoothly move the entire movable wall part depending on the change in the internal pressure of the bottle.

Accordingly, in the portion connected between the movable wall part and the standing peripheral wall part, even when an angle (depression angle) between a tangential line of the movable wall part and a horizontal plane is increased to improve the reduced-pressure absorption performance, it is possible to inhibit difficulty in the upward movement of the movable wall part. As a result, it is possible to improve the performance of absorbing the pressure reduced in the bottle and then to smoothly move the movable wall part.

Further, a downward swelling part which is recessed downward may be formed in the movable wall part at a position where is at more inner side in the radial direction of the bottle than the upward swelling part.

In this case, a length from an outer end to an inner end of the movable wall part in a radial direction of the bottle is longer than a tangential length of a virtual line that extends along a surface shape of the movable wall part connecting an inner end of the standing peripheral wall part in the radial direction of the bottle and an outer end of the depression peripheral wall part in the radial direction of the bottle. Thereby, it is possible to secure an amount of movement of the movable wall part and to further improve the reduced-pressure absorption performance.

Advantageous Effects of Invention

According to the foregoing bottle, the improvement in the performance of absorbing the pressure reduced in the bottle is attempted to allow the movable wall part to move smoothly.

DESCRIPTION OF EMBODIMENTS

Hereinafter, a bottle according to an embodiment of the present invention will be described with reference to the drawings.

Figure 1:
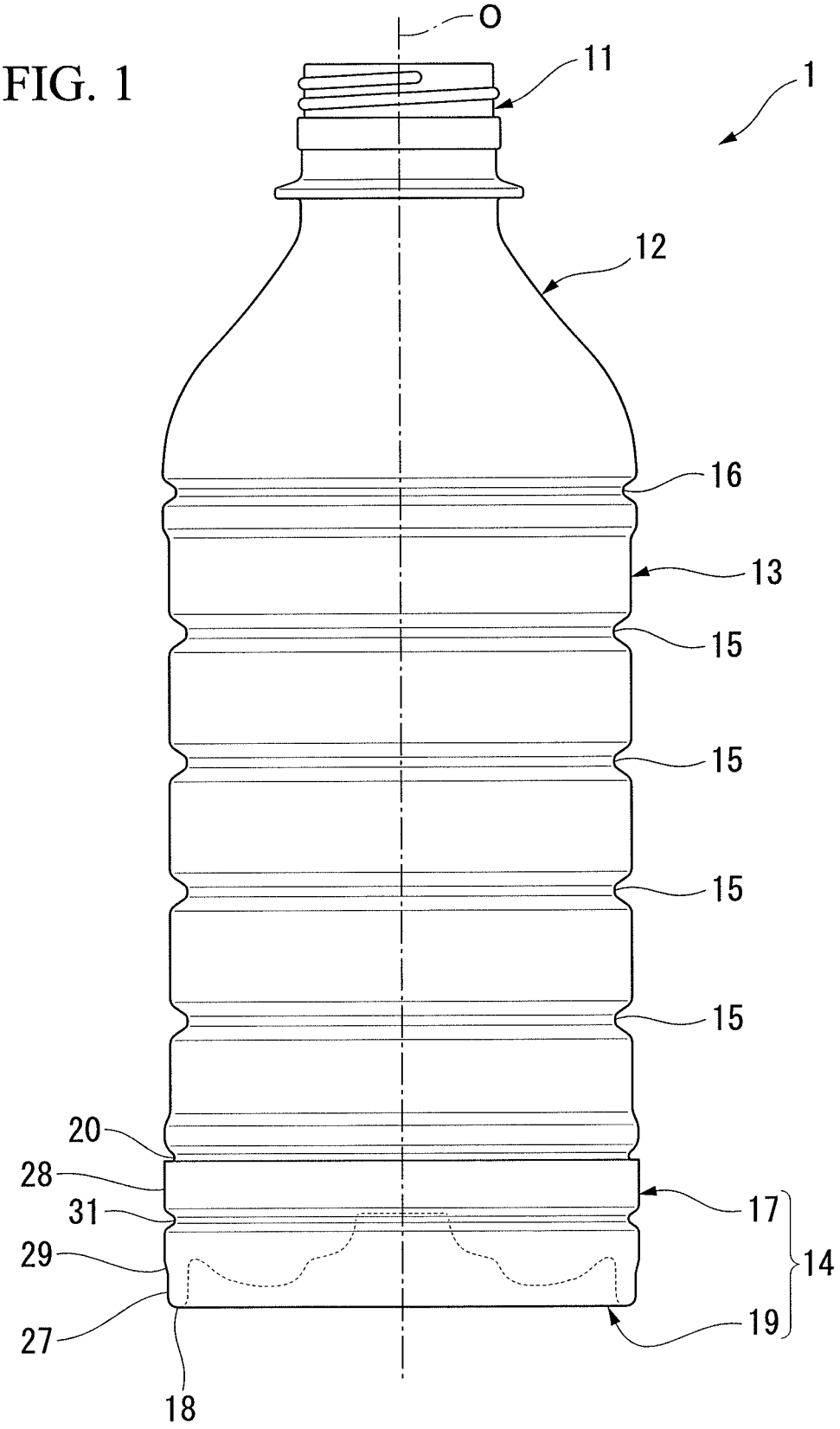
FIG. 1 is a front view of a bottle in an embodiment of the present invention.
Figure 2:
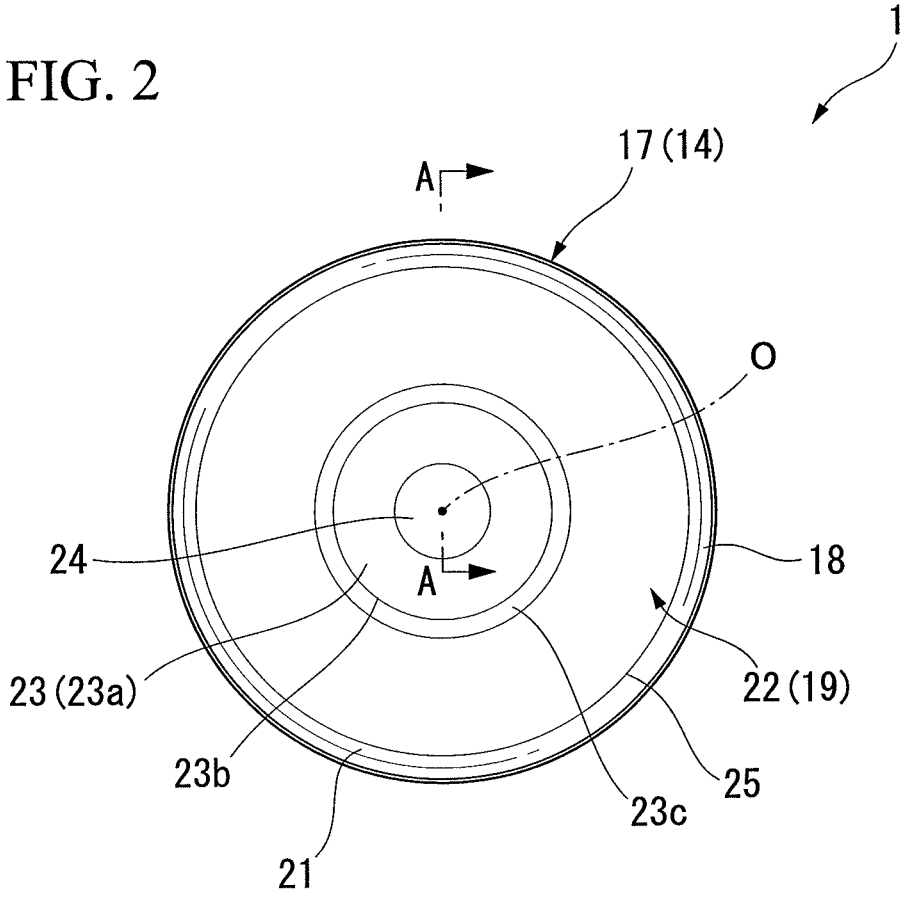
FIG. 2 is a bottom view of the bottle in the embodiment of the present invention.

As shown in FIG. 1, a bottle 1 according to the present embodiment includes a mouth part 11, a shoulder part 12, a trunk part 13, and a bottom part 14, and has a schematic constitution in which these parts 11 to 14 cause respective central axes thereof to be placed on a common axis, and are continuously connected in this order.

Hereinafter, the common axis is referred to as a bottle axis O. In the direction of the bottle axis O, a side of the mouth part 11 is referred to as an upper side, and a side of the bottom part 14 is referred to as a lower side. Further, a direction perpendicular to the bottle axis O is referred to as a radial direction, and a direction going around the bottle axis O is referred to as a circumferential direction.

The bottle 1 is integrally formed of a synthetic resin material by blow molding using a preform formed in a bottomed tubular shape by injection molding. Further, a cap (not shown) is mounted on the mouth part 11. Furthermore, each of the mouth part 11, the shoulder part 12, the trunk part 13, and the bottom part 14 has a circular shape when viewed from a cross section perpendicular to the bottle axis O.

A first annular groove 16 is continuously formed in a portion connected between the shoulder part 12 and the trunk part 13 throughout the circumference of the connected portion.

The trunk part 13 is formed in a tubular shape, and between opposite ends thereof in the direction of the bottle axis O, a diameter thereof is smaller than those of the opposite ends thereof. A plurality of second annular grooves 15 are continuously formed in the trunk part 13 at intervals in the direction of the bottle axis O throughout the circumference of the trunk part 13.

A third annular groove 20 is continuously formed in a portion connected between the trunk part 13 and the bottom part 14 throughout the circumference of the connected portion.

As shown in FIGS. 1 to 3B, the bottom part 14 includes a heel part 17 whose upper end opening is connected to a lower end opening of the trunk part 13, and a bottom wall part 19 which closes a lower end opening of the heel part 17 and whose outer circumferential edge serves as a grounding part 18, and is formed in a cup shape A fourth annular groove 31 is continuously formed in the heel part 17 throughout the circumference of the heel part 17. As shown in FIG. 1, a radial depth of the fourth annular groove 31 is equal to that of the third annular groove 20.

Figure 3A:
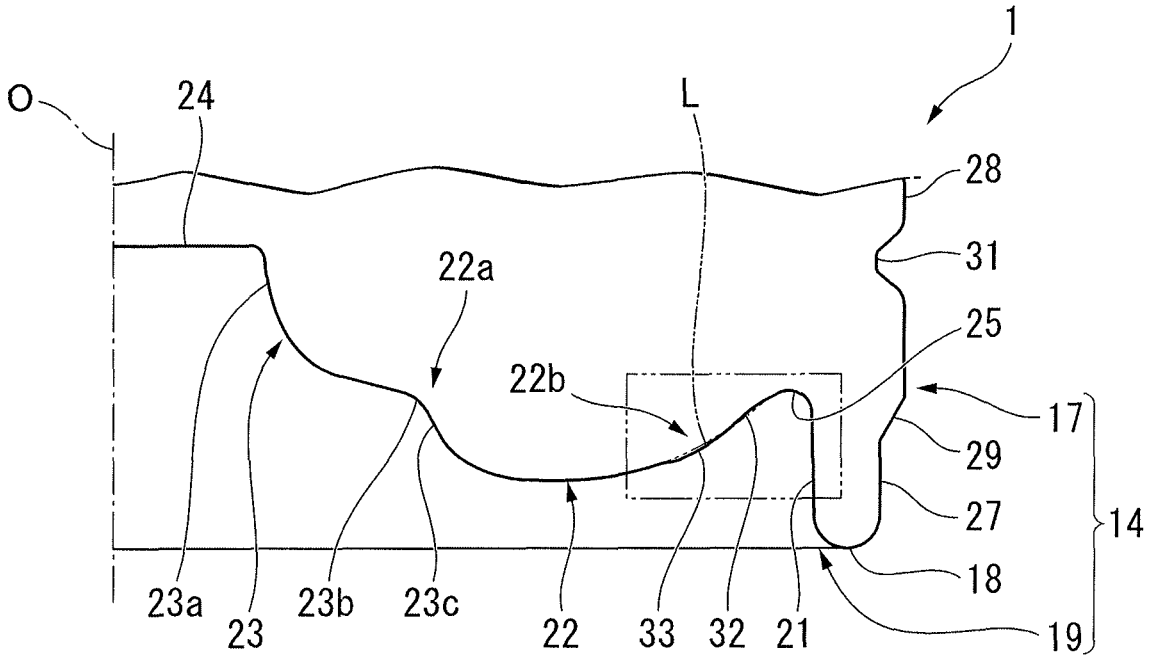
FIG. 3A is a cross-sectional view taken along line A-A of FIG. 2.
Figure 3B:
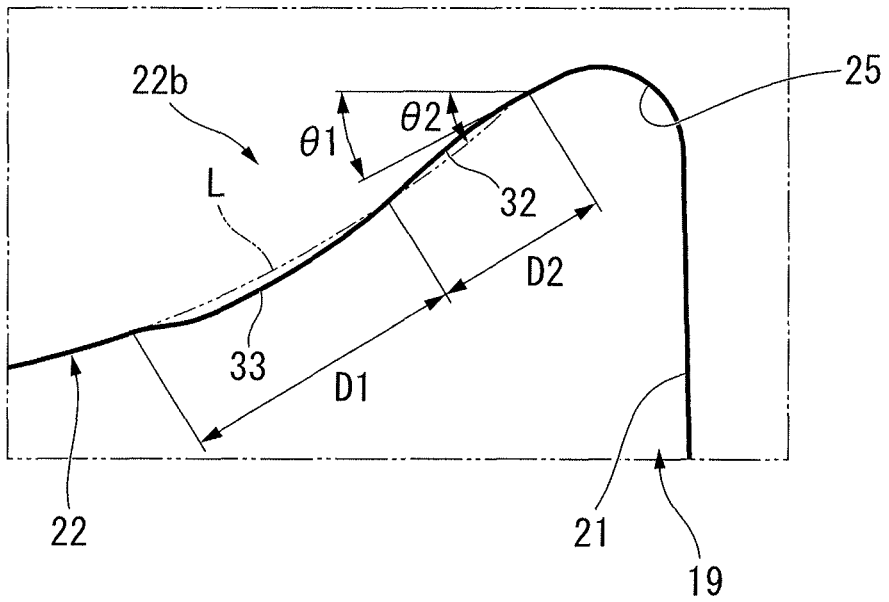
FIG. 3B is an enlarged view of a portion surrounded by a chain double dashed line of FIG. 3A.

As shown in FIG. 3A, the bottom wall part 19 includes a standing peripheral wall part 21 that is connected to the grounding part 18 from a radial inner side and extends upward, an annular movable wall part 22 that protrudes from an upper end of the standing peripheral wall part 21 toward the radial inner side, and a depression peripheral wall part 23 that extends upward from an inner tip of a radial inner end 22*a* of the movable wall part 22.

As shown in FIG. 3A, the standing peripheral wall part 21 is reduced in diameter from a bottom to a top.

The movable wall part 22 is formed in the shape of a curved surface that protrudes downward, and gradually extends downward from the radial outer side to the radial inner side. This movable wall part 22 and the standing peripheral wall part 21 are connected via a curved surface part 25 that protrudes upward. Thus, to cause the depression peripheral wall part 23 to move upward, the movable wall part 122 is formed so as to rotate (move) freely around the curved surface part (a portion connected to the standing peripheral wall part 21) 25 and cause the depression peripheral wall part 23 to move upward.

Here, an upward swelling part 32 swelling upward is formed at a radial outer end 22*b* thereof, that is, at a portion adjacent to the curved surface part 25 in the movable wall part 22. This upward swelling part 32 is formed in the shape of a curved surface that protrudes in a normal direction of the movable wall part 22, and is formed in the shape of a ring that extends over the entire circumference of the circumferential direction. To be specific, the upward swelling part 32 is located above a virtual line L (e.g., a downward inflated curved line or a straight line) that extends along a surface shape of the movable wall part 22 connecting a radial inner end of the curved surface part 25 and a radial outer end of the depression peripheral wall part 23. Further, the top of the upward swelling part 32 is located below the curved surface part 25. In addition, an angle (depression angle) θ1 between a tangential line and a horizontal plane at a radial outer end of the upward swelling part 32 may be set to be smaller than 10 degrees or more with respect to an angle (depression angle) θ1 between a tangential line and a horizontal plane at a radial outer end of the virtual line L. In the shown example, θ1 is set to about 28 degrees, and θ2 is set to about 44 degrees.

Further, a downward swelling part 33 which is recessed downward is formed at a position of the inner side of the radial direction than the upward swelling part 32 in the outer end 22*b* of the movable wall part 22. The downward swelling part 33 is formed in the shape of the curved surface that protrudes in the normal direction of the movable wall part 22, and is formed in the shape of a ring that extends over the entire circumference of the circumferential direction. To be specific, the downward swelling part 33 is located below the above-mentioned virtual line L described above. In this case, the above-mentioned upward swelling part 32 is configured so that the radial outer end thereof is continuously installed on the radial inner end of the curved surface part 25, and a radial inner end thereof is continuously installed on a radial inner end of the radial outer end of the downward swelling part 33.

The upward swelling part 32 is formed with a smaller radius of curvature than the above-mentioned downward swelling part 33. Further, when viewed from the longitudinal cross section in the direction of the bottle axis O, a length D1 of a tangential line from the radial outer end to the radial inner end of the downward swelling part 33 is formed so as to be longer than a length D2 of a tangential line from the radial outer end to the radial inner end of the upward swelling part 32.

The depression peripheral wall part 23 is arranged on the common axis with the bottle axis O, and is gradually increased in diameter from the top to the bottom. A disc-shaped top wall 24 disposed on the common axis with the bottle axis O is connected to an upper end of the depression peripheral wall part 23. A tubular shape having the top is formed by both of the depression peripheral wall part 23 and the top wall 24. The depression peripheral wall part 23 is formed in a circular shape when viewed from the cross section. Further, the depression peripheral wall part 23 is configured so that an upper end of a curved wall part 23*a*, which is formed in the shape of a curved surface protruding toward the radial inner side, is connected to the top wall 24, and a lower end of the curved wall part 23*a* is connected to an inclined wall part 23*c* via an indented part 23*b*. The inclined wall part 23*c* is gradually increased in diameter from the top to the bottom, and a lower end thereof is connected to the inner tip of the radial inner end 22*a* of the annular movable wall part 22.

In the present embodiment, in the heel part 17, a diameter of a lower heel part 27 which is connected from the radial outer side to the grounding part 18 is formed so as to be smaller than a diameter of an upper heel part 28 which is connected from above to the lower heel part 27. The upper heel part 28 is a maximum outer diameter part of the bottle 1 along with the opposite ends of the trunk part 13 in the direction of the bottle axis O.

Furthermore, in the present embodiment, a connecting portion 29 between the lower heel part 27 and the upper heel part 28 is gradually reduced in diameter from the top to the bottom. When viewed from the cross section, a shape of the connecting portion 29 extends from the top to the bottom in a linear shape.

When the pressure in the bottle 1 configured in this way is reduced, the movable wall part 22 rotates about the curved surface part 25 of the bottom wall part 19 in an upward direction. Thereby, the movable wall part 22 moves so as to lift the depression peripheral wall part 23 in an upward direction. In other words, the bottom wall part 19 of the bottle 1 is positively deformed when the pressure is reduced, and thereby a change in the internal pressure (pressure reduction) of the bottle 1 can be absorbed without deformation of the trunk part 13. In this case, the portion connected between the standing peripheral wall part 21 and the movable wall part 22 is formed at the curved surface part 25 protruding upward, and thereby the movable wall part 22 is allowed to easily move (rotate) centering on the curved surface part 25. For this reason, the movable wall part 22 is allowed to be smoothly deformed depending on the change in the internal pressure of the bottle 1.

Especially, in the present embodiment, the upward swelling part 32 swelling upward is formed on the movable wall part 22. Thereby, when the movable wall part 22 moves centering on the curved surface part 25, the upward swelling part 32 becomes a starting point when the movable wall part 22 moves for the first time. In this case, the upward swelling part 32 begins to move upward depending on the change in the internal pressure of the bottle 1. Accordingly, in accordance with the movement, the entire movable wall part 22 moves upward. Thereby, it is possible to smoothly move the entire movable wall part 22 depending on the change in the internal pressure of the bottle 1.

Accordingly, even when the angle θ2 between the tangential line of the movable wall part 22 and the horizontal plane is increased to improve the reduced-pressure absorption performance, it is possible to inhibit difficulty in the upward movement of the movable wall part 22. As a result, it is possible to improve the performance of absorbing the pressure reduced in the bottle 1 and then to smoothly move the movable wall part 22.

Furthermore, in the present embodiment, since a downward swelling part 33 is formed at a position of the inner side of the radial direction than the upward swelling part 32 in the movable wall part 22, the length from the radial outer end 22*b* to the radial inner end 22*a* of the movable wall part 22 is longer than the length of the virtual line L that extends along the surface shape of the movable wall part 22. Thereby, it is possible to secure the amount of movement of the movable wall part 22 and to further improve the reduced-pressure absorption performance.

While the embodiment of the present invention has been described in detail with reference to the drawings, a detailed constitution is not limited to this embodiment, and includes a change in design without departing from the gist of the present invention.

For example, when viewed from a cross section, the shapes of the upward swelling part 32 and the downward swelling part 33 may be appropriately changed in design without being limited to the curved surface shape.

Further, the upward swelling part 32 and the downward swelling part 33 may be intermittently formed in the circumferential direction.

Furthermore, a plurality of downward swelling parts 33 may be formed in the radial direction. For example, the downward swelling parts 33 may be formed in a corrugated shape in the radial direction.

Further, the standing peripheral wall part 21 may be appropriately modified, for instance, may extend in parallel in the direction of the bottle axis O.

Furthermore, the depression peripheral wall part 23 may be appropriately modified, for instance, may extend in parallel in the direction of the bottle axis O.

Further, the synthetic resin material of which the bottle 1 is formed may be appropriately changed into, for instance, polyethylene terephthalate, polyethylene naphthalate, amorphous polyester, or a blended material thereof.

Furthermore, the bottle 1 may have a laminated structure having a medium layer without being limited to a single layer structure. This medium layer may include, for instance, a layer of a resin material having a gas barrier characteristic, a layer of a recycled material, or a layer of a resin material having oxygen absorbability.

In addition, in the embodiment, the shape of each of the shoulder part 12, the trunk part 13, and the bottom part 14 when viewed from the cross section perpendicular to the bottle axis O has the circular shape, but it may be appropriately modified into, for instance, a polygonal shape without being limited thereto.

In addition, without departing from the spirit of the present invention, the components in the embodiment may be properly replaced by well-known components, and the above-mentioned modifications may be appropriately combined.

INDUSTRIAL APPLICABILITY

According to the foregoing bottle, the improvement in the performance of absorbing the pressure reduced in the bottle is attempted to allow the movable wall part to move smoothly.

REFERENCE SIGNS LIST

1: bottle
14: bottom part
18: grounding part
19: bottom wall part
21: standing peripheral wall part
22: movable wall part
23: depression peripheral wall part
25: curved surface part
32: upward swelling part
33: downward swelling part

The invention claimed is:

1. A bottle that is tubular, is formed of a synthetic resin material, and has a bottom part, wherein a bottom wall part of the bottom part includes:

a grounding part which is located at an outer circumferential edge thereof;

a standing peripheral wall part which is connected, from an inner side of a radial direction of the bottle, to the grounding part and which extends upward;

a movable wall part which protrudes from an upper end of the standing peripheral wall part toward the inner side of the radial direction of the bottle; and a depression peripheral wall part which extends upward from an inner end of the movable wall part along the radial direction of the bottle, the depression peripheral wall part extending upward from a radially inner end of the movable wall part, wherein an upper end of the depression peripheral wall part is connected to a radially outer end of a top wall of the bottom wall part, wherein the movable wall part is arranged so as to be movable upward centering on a curved surface part connected to the standing peripheral wall part along with the depression peripheral wall part, wherein an upward swelling part which swells upward is formed at an outer end along the radial direction of the bottle of the movable wall part, wherein the upward swelling part is located above a virtual straight line that extends along a surface shape of the movable wall part connecting a radial inner end of the curved surface part and a radial outer end of the depression peripheral wall part, wherein the upward swelling part is formed in a shape of a curved surface that protrudes in a normal direction relative to the virtual line, and wherein a top of the upward swelling part is located below the curved surface part connected to the standing peripheral wall part.

2. The bottle according to claim 1, wherein a downward swelling part which is recessed downward is formed in the movable wall part at a position where is at more inner side in the radial direction of the bottle than the upward swelling part.

3. The bottle according to claim 1, wherein a first angle between a tangential line and a horizontal plane at a radial outer end of the upward swelling part is set to be smaller with respect to a second angle between a tangential line and a horizontal plane at a radial outer end of the virtual line.

4. The bottle according to claim 1, wherein the upward swelling part is formed adjacent to and radially inward of the curved surface part.

* * * * *